US008803404B2

(12) United States Patent
Kwon et al.

(10) Patent No.: US 8,803,404 B2
(45) Date of Patent: Aug. 12, 2014

(54) ULTRASOUND PROBE AND MANUFACTURING METHOD THEREOF

(75) Inventors: Oh Soo Kwon, Gunpo-si (KR); Jeong Pyo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 235 days.

(21) Appl. No.: 13/039,363

(22) Filed: Mar. 3, 2011

(65) Prior Publication Data

US 2011/0316389 A1 Dec. 29, 2011

(30) Foreign Application Priority Data

Jun. 28, 2010 (KR) ..... 10-2010-0061097

(51) Int. Cl.
*H04R 31/00* (2006.01)

(52) U.S. Cl.
USPC ..... 310/334; 310/335; 29/594

(58) Field of Classification Search
CPC ..... G10K 11/30; G10K 11/02; B06B 1/0622
USPC ..... 310/334, 335; 29/594
See application file for complete search history.

(56) References Cited

U.S. PATENT DOCUMENTS

| | | | | |
|---|---|---|---|---|
| 6,043,590 | A * | 3/2000 | Gilmore | 310/367 |
| 6,153,967 | A * | 11/2000 | Kobayashi et al. | 310/334 |
| 7,249,513 | B1 * | 7/2007 | Zipparo et al. | 73/625 |
| 7,288,069 | B2 * | 10/2007 | Takeuchi et al. | 600/459 |
| 7,808,157 | B2 * | 10/2010 | Oakley et al. | 310/334 |
| 2009/0034370 | A1 * | 2/2009 | Guo | 367/180 |
| 2010/0066207 | A1 * | 3/2010 | Saito | 310/335 |

FOREIGN PATENT DOCUMENTS

JP 200227593 A 1/2002

OTHER PUBLICATIONS

Communication, dated Jun. 27, 2013, issued by the Korean Patent Office in counterpart Korean Application No. 10-2010-0061097.

* cited by examiner

*Primary Examiner* — Derek Rosenau
*Assistant Examiner* — Bryan Gordon
(74) *Attorney, Agent, or Firm* — Sughrue Mion, PLLC

(57) ABSTRACT

An ultrasound probe and a method for manufacturing the same are provided. More particularly, a one-dimensional or two-dimensional ultrasound probe having a multi-element-type piezoelectric material is easily manufactured by inserting a flat wire in a backing material, wherein the flat wire is used as a signal cable to supply electrical signals, enabling easy and simple arrangement of piezoelectric units as well as the signal cable.

22 Claims, 13 Drawing Sheets

ULTRASOUND PROBE AND MANUFACTURING METHOD THEREOF

CROSS-REFERENCE TO RELATED APPLICATION

This application claims priority from Korean Patent Application No. 10-2010-061097, filed on Jun. 28, 2010 with the Korean Intellectual Property Office, the entire disclosure of which is incorporated herein by reference.

BACKGROUND

1. Field

Apparatuses and methods consistent with embodiments relate generally to ultrasound probes and, more particularly, to an ultrasound probe having a piezoelectric material to emit and receive ultrasound and a method for manufacturing the same.

2. Description of the Related Art

An ultrasound probe refers to a device which emits ultrasound to a target object and receives an ultrasound echo reflected from the target object, so as to generate images of the inside of the target object. The ultrasound probe may use a piezoelectric material to generate ultrasound and receive the ultrasound reflected from the target object. A related art ultrasound probe generally has a piezoelectric element, a matching layer, a backside film and a circuit board. According to related art techniques, in order to connect the piezoelectric element to an external signal terminal, the circuit board is placed inside the backside film and a signal cable is drawn out of a rear side of the backside film. When the circuit board is embedded in the backside film, a thin gauge signal cable must be used, and it is difficult to match multiple signal cables with piezoelectric elements corresponding thereto.

SUMMARY

Exemplary embodiments provide an ultrasound probe having a signal cable which is a flat wire, as well as a method for manufacturing the same.

According to an aspect of an exemplary embodiment, there is provided an ultrasound probe including: a piezoelectric material; a matching layer disposed on a front side of the piezoelectric material; an acoustic lens disposed on a front side of the matching layer; at least one backing material disposed on a rear side of the piezoelectric material and including a plurality of flat wires; and a signal supply part provided on at least one side of the backing material and electrically connected to the plurality of flat wires.

The signal supply part may include a flexible printed circuit board (FPCB), a printed circuit board (PCB) or an electrical wire.

The plurality of flat wires may be disposed in the backing material and may extend through the backing material such that a width of the plurality of flat wires corresponds to a width of the backing material.

The plurality of flat wires may be aligned within the backing material to form multiple rows extending in a lengthwise direction of the backing material, and the rows may be formed such that the plurality of flat wires in one of the rows the are alternately arranged in the lengthwise direction with respect to the flat wires in the other one of the rows.

The plurality of flat wires may be exposed from the front of the backing material in order to provide electrical signals to the piezoelectric material, and wherein the plurality of flat wires may be exposed on either a lateral side or a rear side of the backing material in order to receive electrical signals from the signal supply part.

An electrode may be placed on at least one of the front side, the lateral side and the rear side of the backing material.

The signal supply part may be mounted on at least one of the lateral side and the rear side of the backing material to supply electrical signals to the backing material.

The matching layer as well as the piezoelectric material may be divided in a width direction into plural sections equal in number to the number of the plurality of flat wires placed in the backing material.

The piezoelectric material may include a first electrode layer and a second electrode layer on the front and rear sides of the piezoelectric material, respectively.

The first electrode layer is a ground electrode to be connected to the signal supply part, while the second electrode layer may be connected to the plurality of flat wires of the backing material.

According to an aspect of another exemplary embodiment, there is provided a method for manufacturing an ultrasound probe, including: preparing a jig having evenly spaced grooves; positioning a flat wire in each groove of the jig; embedding the jig in a molding material and removing the jig from the molding material to form a backing material; processing a surface of the backing material to expose the flat wire in each groove at the surface of the backing material.

The method may further include: forming an electrode on at least one of a front side surface, a lateral side surface and a rear side surface of the surface-processed backing material; mounting a piezoelectric material on the front side of the backing material; mounting a matching layer on a front side of the piezoelectric material; dividing the piezoelectric material and the matching layer at constant intervals; providing an acoustic lens on a front side of the matching layer; and providing a signal supply part on the lateral side or the rear side of the backing material.

The signal supply part may include an FPCB, a PCB or an electrical wire.

The grooves of the jig may be present at opposing first and second sides of the jig, and wherein the grooves at both sides may be alternately arranged with respect to one another.

The molding material may include a mixture of a first material and a second material, the first material is at least one of silicon, epoxy resin and rubber, and the second material is at least one of metal and ceramic powder.

The piezoelectric material and the matching layer may be divided into partitioned units such that each partitioned unit of the piezoelectric material is connected with one of the flat wires positioned in the backing material.

According to an aspect of another exemplary embodiment, there is provided a method for manufacturing an ultrasound probe, including: preparing a plurality of jigs, each having a plurality of grooves formed at constant intervals; positioning a flat wire in each groove of the jig; charging a molding material between the jigs to embed the jigs in the molding material, and removing the jigs to form a backing material; processing a surface of the backing material to expose each flat wire at the surface; mounting a piezoelectric material on a front side of the backing material; mounting a matching layer on a front side of the piezoelectric material; dividing both the piezoelectric material and the matching layer into multiple units, each divided unit having a constant area; providing an acoustic lens on a front side of the matching layer; and providing a signaling unit on a rear side of the backing material.

The method may further include forming an electrode on at least one of a front side, a lateral side and a rear side of the surface-processed backing material.

The signal supply part may include an FPCB, a PCB or an electrical wire.

The piezoelectric material and the matching layer may be divided into partitioned units in a mesh form such that a partitioned unit is connected with one of the flat wires positioned in the backing material.

The molding material may include a mixture of a first material and a second material, wherein the first material is at least one of silicon, epoxy resin and rubber, and wherein the second material is at least one of a metal and ceramic powder.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION

Figure 1:
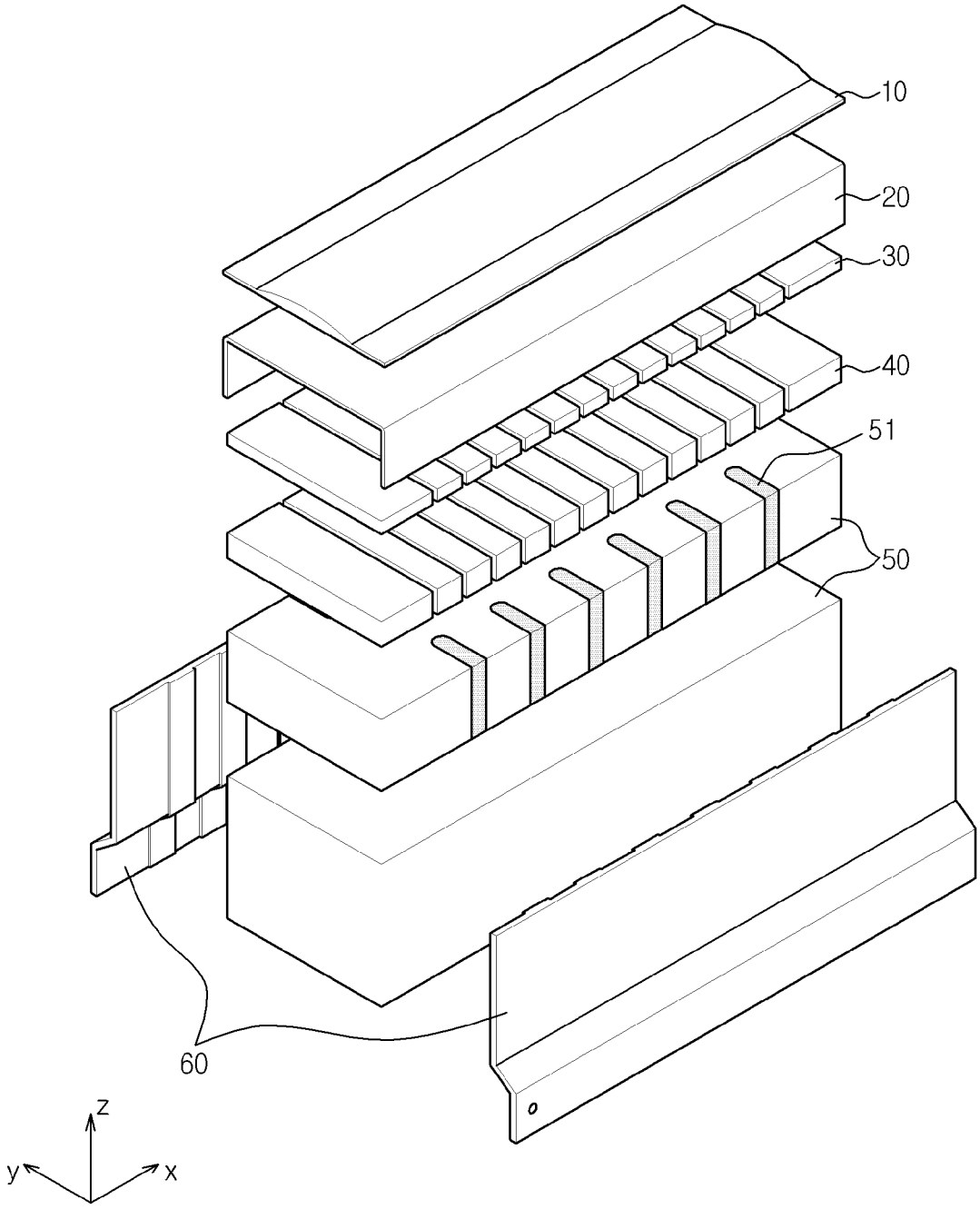
FIG. 1 is an exploded perspective view illustrating an ultrasound probe according to an exemplary embodiment.

Hereinafter, the ultrasound probe and a method for manufacturing the same according to an exemplary embodiment will be described with reference to the accompanying drawings.

The same numerical symbols in the drawings refer to substantially the same constitutional elements.

FIG. 1 is an exploded perspective view illustrating an ultrasound probe according to one exemplary embodiment.

According to an exemplary embodiment, the ultrasound probe includes: a piezoelectric material 40; a matching layer 30 provided on a front side of the piezoelectric material 40; a protective layer 20 formed on a front side of the matching layer 30; an acoustic lens 10 mounted on a front side of the protective layer 20; at least one layer of backing material 50 which is provided on a rear side of the piezoelectric material 40 and which includes a plurality of flat wires 51 provided therein; and a signal supply part, such as an FPCB 60, installed on a lateral side or a rear side of the backing material 50, so as to supply electric current to the piezoelectric material 40.

Certain materials exhibit a feature in which application of mechanical pressure to the material creates an electric potential; conversely, application of an electrical potential to the material can result in deformation thereof. This property is referred to as the piezoelectric effect, and materials exhibiting this property are referred to as piezoelectric materials. Briefly, the piezoelectric material is a material to convert electrical energy into mechanical vibration and/or the mechanical vibration into the electrical energy.

When an electrical signal is applied to the piezoelectric material 40, it converts the electrical signal into mechanical vibration to generate ultrasound. The piezoelectric material 40 has a first electrode layer (not shown) formed on a front side thereof and a second electrode layer (not shown) formed on a rear side thereof. The first electrode layer serves as a ground electrode while the second electrode functions as a signal electrode to receive an electrical signal input. The first and second electrode layers may be prepared using a conductive material and be attached to front and rear sides of the piezoelectric material 40, respectively. Alternatively, the first and second electrode layers may directly construct top and bottom faces of the piezoelectric material 40. The first electrode layer may be connected to the FPCB 60, while the second electrode layer may be connected to the flat wire 51 exposed from a front side of the backing material 50. The piezoelectric material 40 may be formed using lead zirconium titanate (PZT) ceramic, PZMT single crystals made of a solid solution of lead magnesium niobate and lead titanate, PZNT single crystals made of a solid solution of lead zinc niobate and lead titanate, and so forth.

Figure 3:
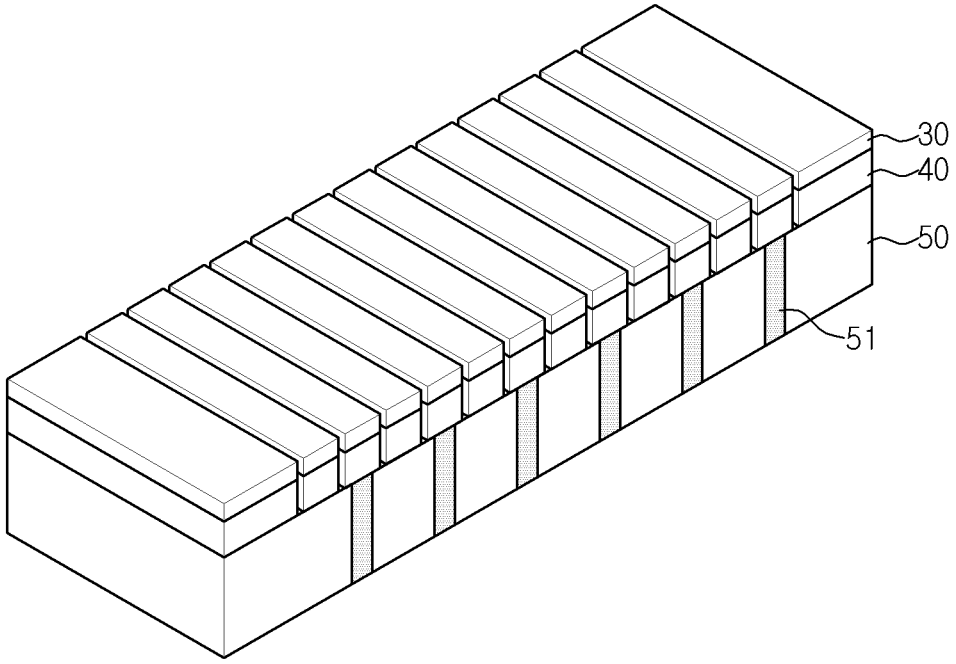
FIG. 3 is a perspective view illustrating a piezoelectric material and a matching layer according to an exemplary embodiment.

The matching layer 30 may be provided on a front side of the piezoelectric material 40 to reduce a difference in acoustic impedance between the piezoelectric material 40 and a target object (not shown), in turn effectively transferring ultrasound generated from the piezoelectric material 40 to the target object. The matching layer 30 as well as the piezoelectric material 40 may be divided into plural units by a dicing process so that they have a constant width (FIG. 3).

The protective layer 20 may be provided on a front side of the matching layer 30 in order to prevent leakage of ultrasound generated from the piezoelectric material 40 while blocking input of external high frequency signals. The protective layer 20 may protect internal components from chemicals used to disinfect the ultrasound probe as well as water that may come in contact with the ultrasound probe. The protective layer 20 may be a conductive material applied or deposited to a surface of a film to provide moisture resistance and chemical resistance.

The acoustic lens 10 may be provided on a front side of the matching layer 30 and enables ultrasound to be focused upon the target object.

The backing material 50 is provided on a rear side of the piezoelectric material 40 and absorbs ultrasound generated from the same in order to prevent ultrasound from advancing toward the rear side of the piezoelectric material 40, thus preventing image distortion. The backing material 50 may be formed into multiple layers in order to enhance ultrasound attenuation or shielding effects.

Figure 4A:
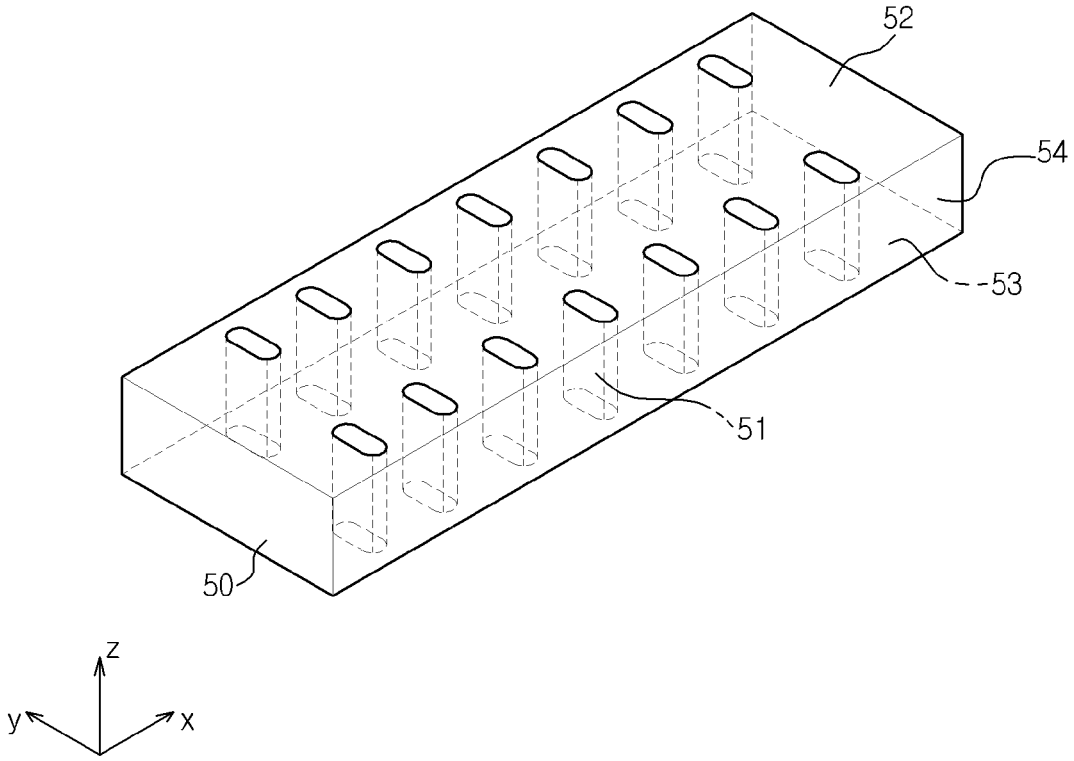
FIGS. 4A and 4B are conceptual views illustrating a backing material according to an exemplary embodiment.
Figure 4B:
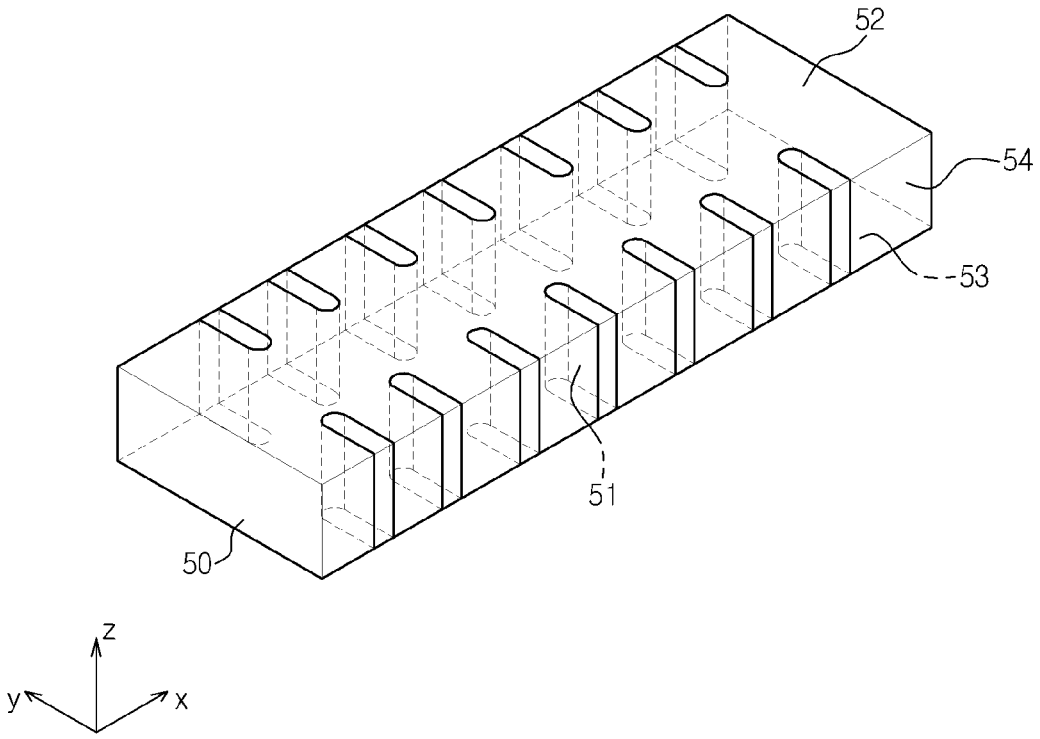

The backing material 50 may have multiple wires 51 embedded therein to provide electrical signals to the piezoelectric material 40 (FIGS. 4A and 4B). According to an exemplary embodiment, the wire 51 may be a flat wire. Such a flat wire 51 may be made of an alloy comprising gold, silver, copper, aluminum and/or magnesium. Referring to FIGS. 4A and 4B, a plurality of flat wires 51 are embedded in the backing material 50 to extend through front and rear sides (in a Z axis direction) of the backing material 50. The multiple flat wires 51 may be arranged in two rows extending in a lengthwise direction (X axis direction) of the backing material 50, and these rows may be formed such that the flat wires 51 in the in one row are alternately arranged in the lengthwise direction with respect to the flat wires 51 in the other row. The flat wires 51 may be arranged such that a width direction of the flat wires 51 (Y axis direction) is consistent with a width direction of the backing material 50 (Y axis direction).

Figure 10:
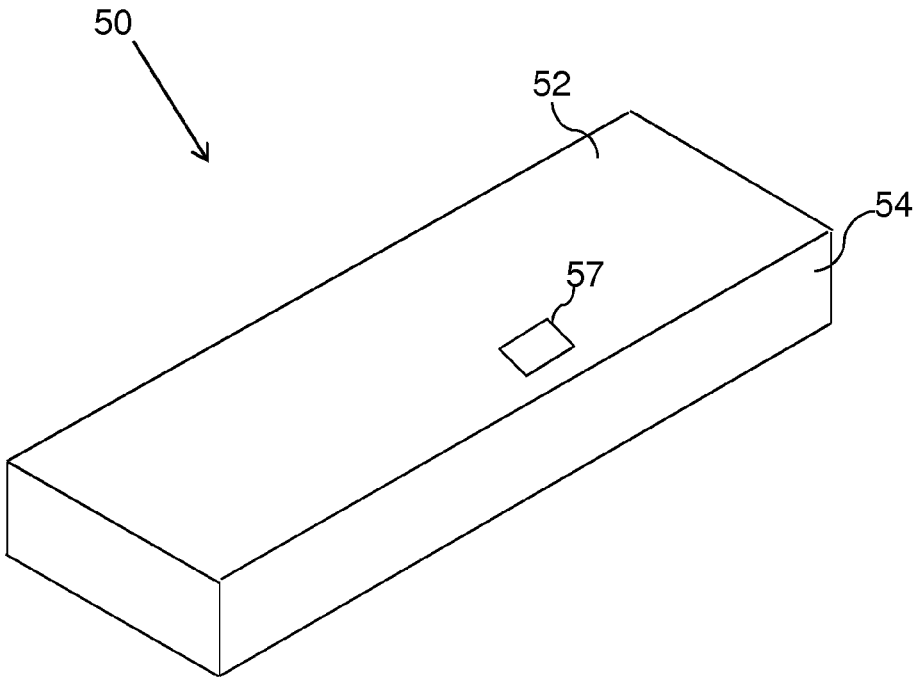
FIG. 10 schematically illustrates an electrode provided on the backing material.

If the plurality of flat wires 51 with the foregoing structure are embedded in the backing material 50, the backing material 50 may be subjected to surface processing in order to expose the flat wires 51 at front, rear and lateral sides 52, 53 and 54 of the backing material 50. The flat wires 51 exposed at the front side 52 of the backing material 50 may be connected to the piezoelectric material 40 mounted on the front side of the backing material 50. With reference to FIG. 10, to electrically connect the flat wires 51 with the piezoelectric material 40, an additional electrode 57 may be formed on the front side 52 of the backing material 50 by plating or deposition, and such an electrode may be divided through dicing. Additionally, such additional electrode may be provided at least on one of the lateral side 54 or the rear side 53 of the backing material 50. One of the flat wires 51 may be in contact with each unit of the piezoelectric material 40 divided through dicing and may transfer electrical signals thereto. The flat wires 51 exposed at the lateral side 54 or the rear side 53 of the backing material 50 may be connected to the FPCB 60 provided on the lateral side 54 or the rear side 53 of the backing material 50. In order to electrically connect the flat wires 51 with the FPCB 60 on the lateral side 54 or the rear side 53 of the backing material 50, the backing material 50 may further have an electrode provided on the lateral side 54 and/or the rear side 53, as described above. The electrical signal generated from the FPCB 60 may be transferred toward the piezoelectric material 40 mounted on the front side 52 of the backing material 50 by the flat wire 51.

Figure 5:
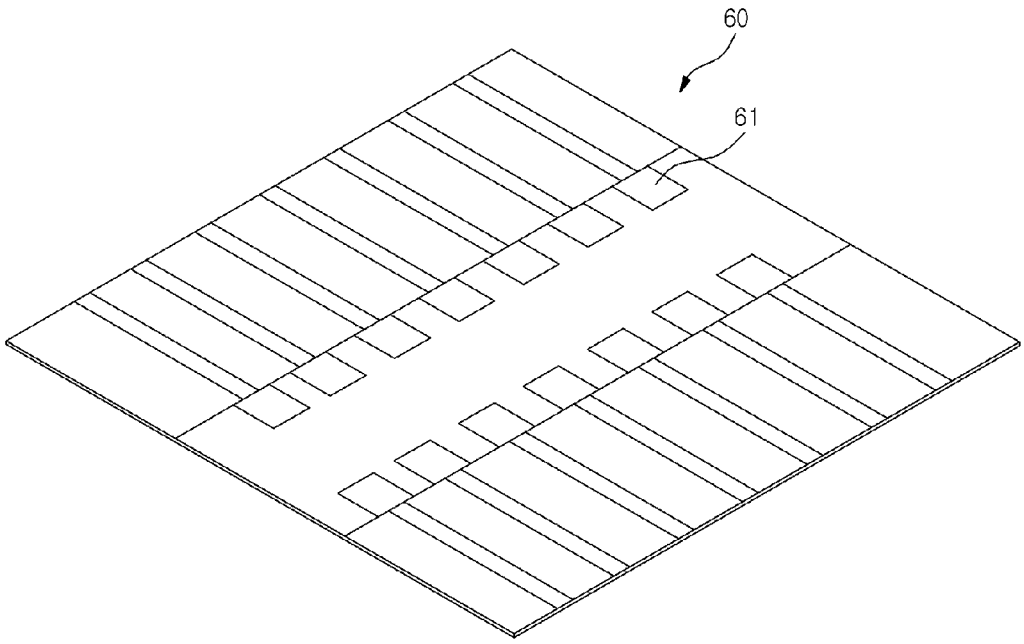
FIG. 5 is a schematic view illustrating a flexible printed circuit board according to an exemplary embodiment.

The FPCB 60 may be provided on the lateral side 54 of the backing material 50 and may supply electrical signals to the piezoelectric material 40. Alternatively, the FPCB 60 may also be provided on the rear side 53 of the backing material 50 to supply electrical signals to the piezoelectric material 40 (see FIG. 5). For the FPCB 60 mounted on the rear side of the backing material 50 to supply electrical signals to the piezoelectric material 40, a contact unit 61 electrically connected with the flat wire 51 exposed at the rear side of the backing material 50 is suitably positioned to match a position of a corresponding flat wire 51. Instead of the FPCB 60, the signal supply part may be embodied as another component such as a PCB or an electrical wire to supply electrical signals.

Figure 6:
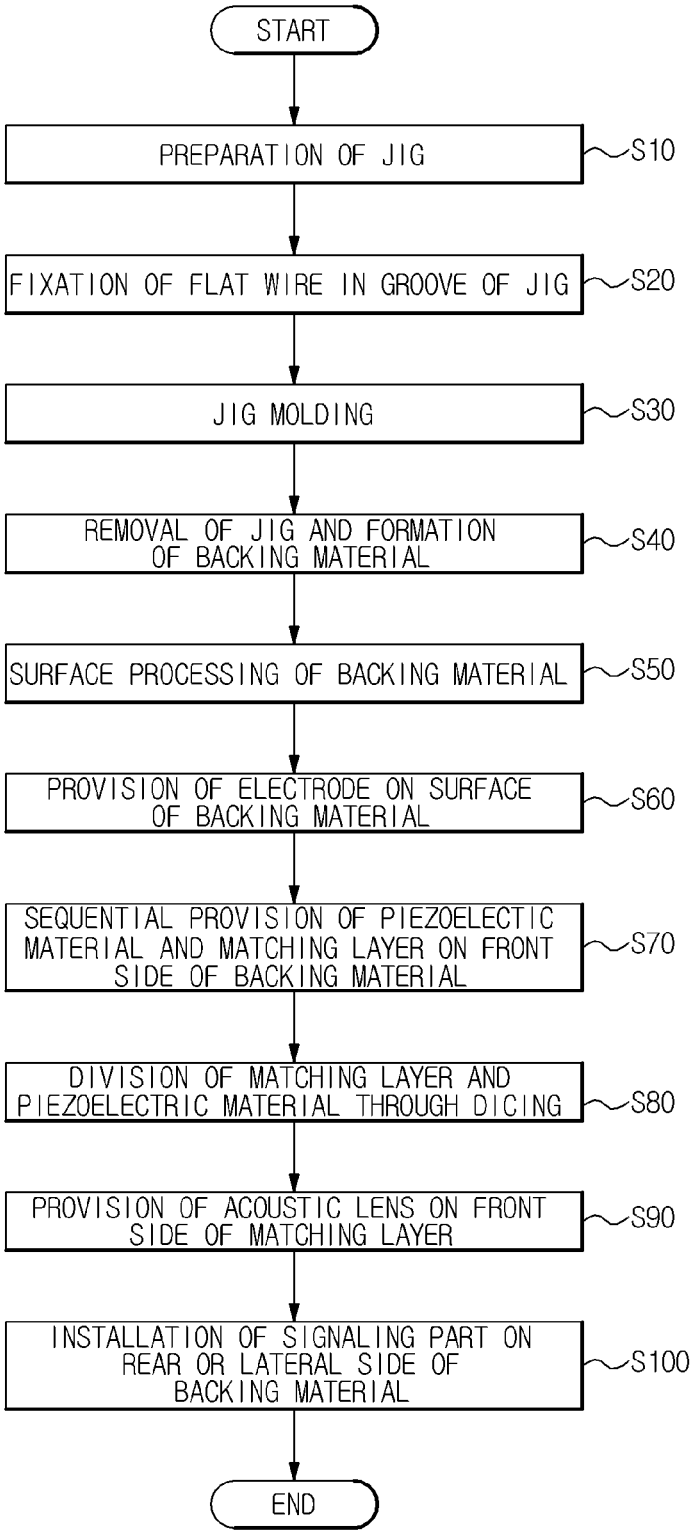
FIG. 6 is a flow chart explaining a process of manufacturing an ultrasound probe according to an exemplary embodiment.

FIG. 6 is a flow chart explaining a process of manufacturing an ultrasound probe according to one exemplary embodiment.

Figure 7A:
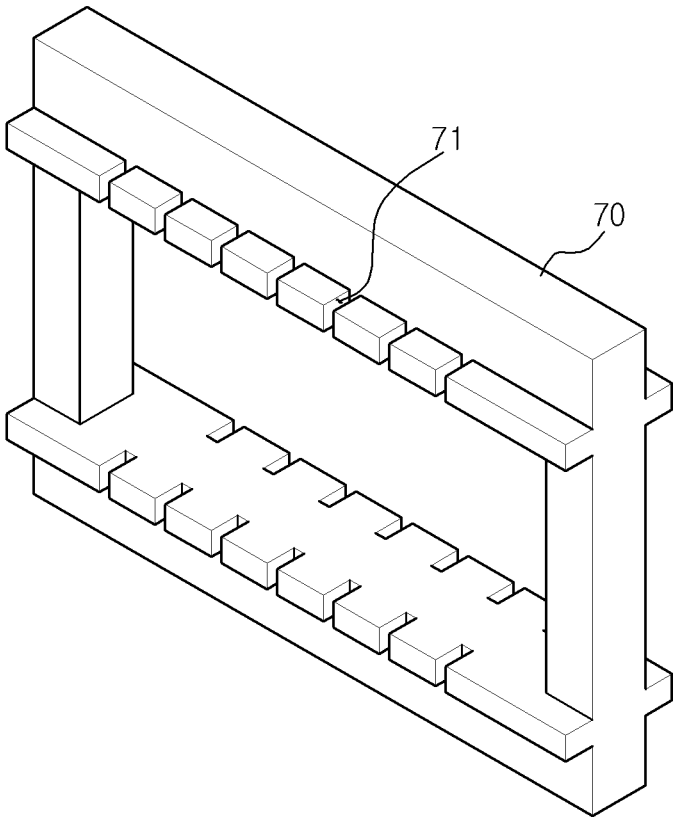
FIGS. 7A and 7B are two perspective views illustrating a jig.

In order to fabricate the ultrasound probe according to the foregoing exemplary embodiment, a jig 70 is first prepared (S10; also FIG. 7A). The jig 70 is an assistant device to easily and correctly determine a mechanical working position.

Figure 7B:
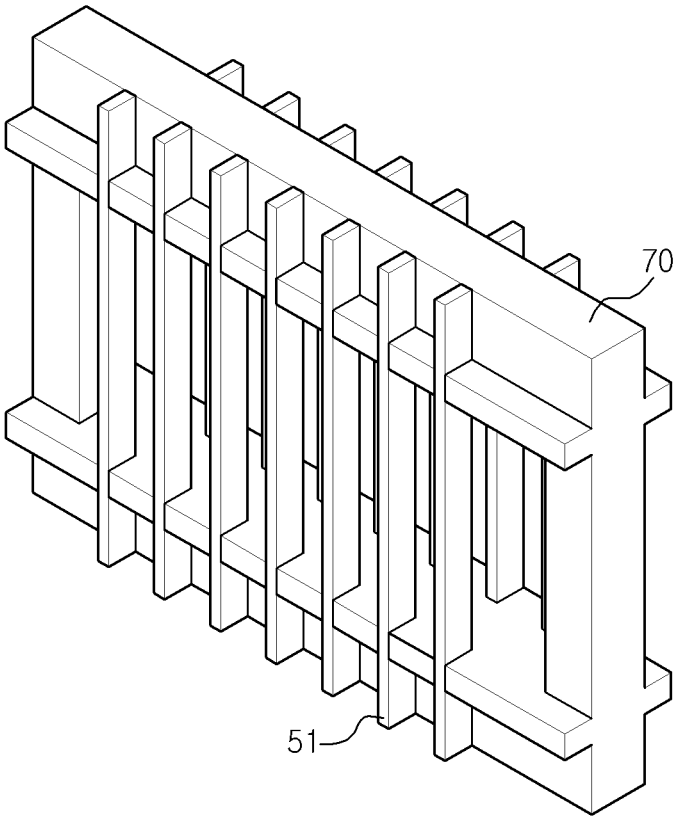
Figure 7C:
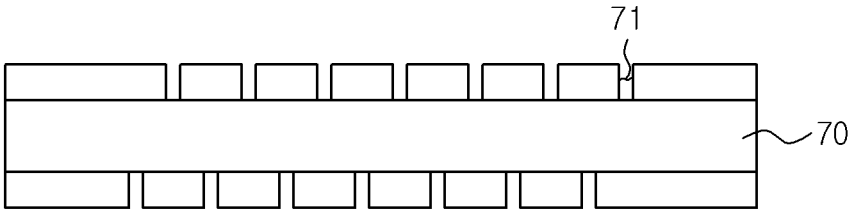
FIG. 7C is a plan view illustrating the jig, according to an exemplary embodiment.

As illustrated in FIG. 7A, the jig 70 used in the process of manufacturing an ultrasound probe according to the foregoing exemplary embodiment has grooves 71 formed on both sides of the jig 70 at constant intervals, in which the flat wires 51 may be fixed. Additionally, the grooves 71 present on both sides of the jig are alternately arranged with respect to one another (FIG. 7C). Otherwise, two jigs 70, each of which has grooves 71 formed on either side thereof, may be used.

The flat wires 51 are fixed in the grooves 71 of the prepared jig 70 (S20). As shown in FIG. 7B, the flat wire 51 may be fitted between both corresponding grooves 71 or wound around the grooves 71 of the jig 70, thus being fixed therein.

After fixing the flat wire 51 in the groove 71 of the jig 70, the jig is subjected to molding (S30). In order to increase acoustic impedance of the backing material 50, the jig 70 to which the flat wire 51 is fixed may be molded using a mixture comprising any one material selected from silicon, epoxy resin and rubber and metal, or a high density or high elastic modulus material such as ceramic powder. After molding, the molding material is cured.

After curing the molding material, the jig 70 is removed to form the backing material 50 (S40). When the jig 70 having the flat wire 51 fixed therein is removed, the flat wire 51 may be embedded and fixed in the cured molding material; that is, the backing material 50, as shown in FIG. 4A.

After removing the jig 70, the backing material 50 is subjected to surface processing in order to expose the flat wire 51 at a surface of the backing material 50, as it was previously embedded in the backing material 50 (S50). Surface processing the backing material 50 may expose the flat wire 51, which was embedded in the backing material, at the front side 52, the lateral side 54 and the rear side 53 of the backing material 50 (see FIG. 4B).

After the surface processing of the backing material 50, an electrode (not shown) may be formed on the front side 52, the lateral side 54 or the rear side 53 of the backing material 50, so as to electrically connect the flat wire 51 of the backing material 50 to the piezoelectric material 40 or the FPCB 60 (S60). The piezoelectric material 40 and the matching layer 30 are sequentially mounted on the front side 52 of the surface-processed backing material 50 (S70). After the piezoelectric material 40 and the matching layer 30 are provided, both of these elements are divided through dicing (S80). The matching layer 30 and the piezoelectric material 40 are divided such that a partitioned piezoelectric unit is connected to each flat wire 51 exposed at the front side of the backing material 50 (see FIG. 3). Accordingly, the number of the partitioned piezoelectric units may be substantially equal to the number of the flat wires 51 in the backing material 50.

After dividing the matching layer 30 and the piezoelectric material 40, a protective layer 20 and an acoustic lens 10 are provided on a front side of the matching layer 30 (S90), and the FPCB 60 is provided on the rear side 53 or the lateral side 54 of the backing material 50 (S100).

A process for fabrication of a two-dimensional array-type ultrasound probe, as opposed to the linear-type ultrasound probe described above, will be clearly understood from the following detailed description.

Figure 8:
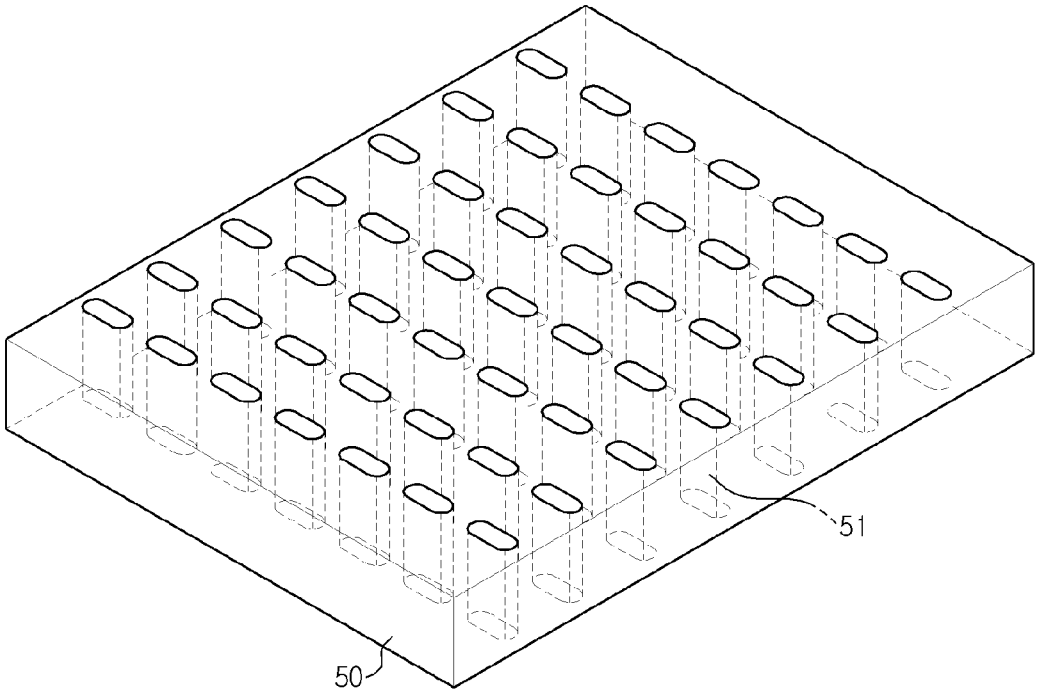
FIG. 8 is a conceptual view showing a backing material according to another exemplary embodiment.

In order to manufacture a two-dimensional array-type ultrasound probe according to another exemplary embodiment, a plurality of jigs 70 are first prepared. Each of the jigs 70 may have grooves 71 formed only on one side of the jig or, otherwise, on both sides thereof. The prepared jig 70 may be provided in plural. Hereinafter, a jig 70 having grooves formed on both sides thereof will be exemplified and described in detail. Flat wires 51 are fixed in the grooves 71 of the jig 70. As shown in FIG. 7B, each flat wire 51 may be fitted between both grooves 71 or wound around the grooves 71 of the jig 70, thus being fixed therein. After fixing the flat wire 51 in the groove 71 of the jig 70, the plural jigs are subjected to molding. In order to increase acoustic impedance of the backing material 50, the jig 70 to which the flat wire 51 is fixed may be molded using a mixture comprising any one first material selected from silicon, epoxy resin and rubber combined with a second material such as a metal or a high density or elastic modulus material such as ceramic powder. Then the molding material is cured. After curing the molding material, the jig 70 is removed to form the backing material 50. The backing material 50 may have the plural flat wires 51 embedded in a matrix form comprising multiple rows and columns in the backing material (FIG. 8). The foregoing process for fabrication of a two-dimensional array-type ultrasound probe can employ the same jig 70 as used in a process for manufacturing a linear-type ultrasound probe. The fabrication process is instead done in plural. Therefore, such a two-dimensional ultrasound probe does not require an additional jig designed with a high precision structure.

Figure 2:
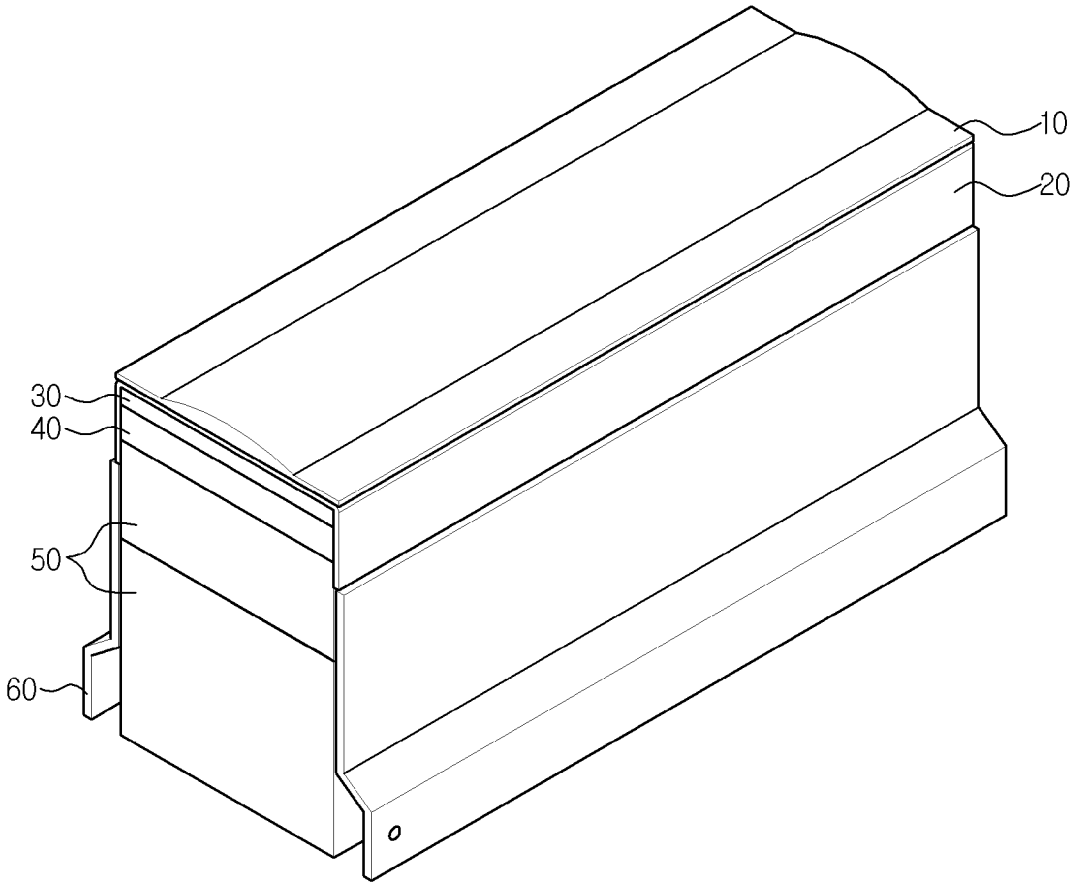
FIG. 2 is a perspective view illustrating an ultrasound probe according to an exemplary embodiment.
Figure 9:
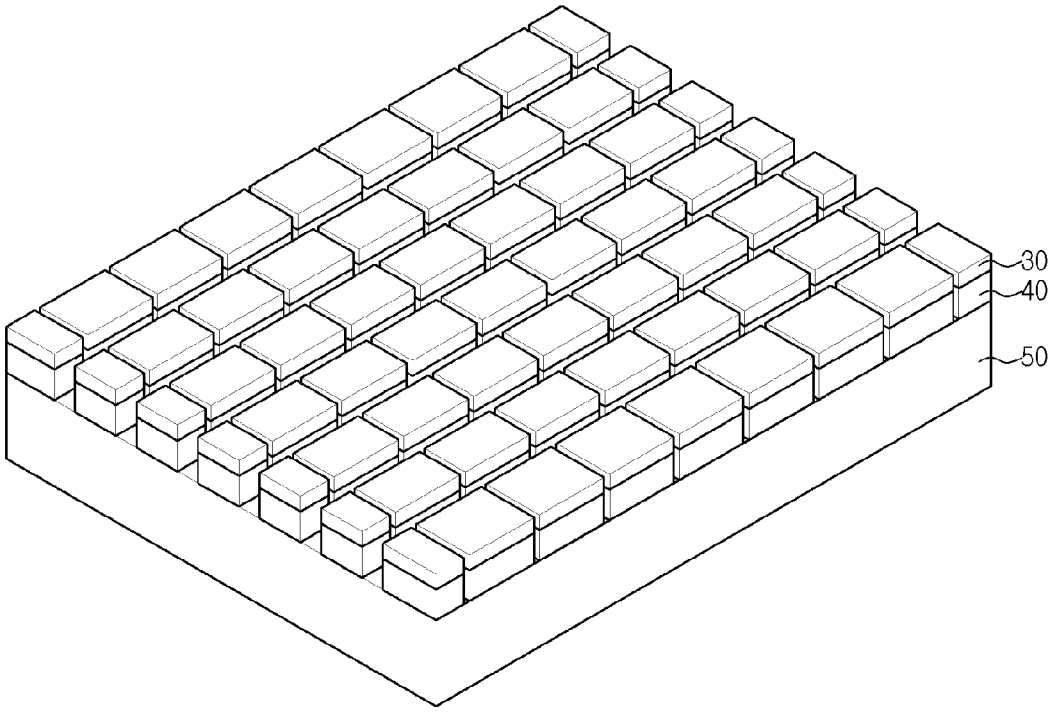
FIG. 9 is a perspective view illustrating a piezoelectric material and a matching layer according to another exemplary embodiment.

After formation of the backing material 50, the backing material is subjected to surface processing in order to expose the flat wire 51 embedded in the backing material 50 at a front side and a rear side of the backing material 50. After surface processing, an electrode (not shown) may be formed on the front side 52, the lateral side 54 or the rear side 53 of the backing material 50 so as to electrically connect the flat wire 51 of the backing material 50 with the piezoelectric material 40 or the FPCB 60. The piezoelectric material 40 and the matching layer 30 are sequentially mounted on the front side 52 of the surface-processed backing material 50, and both of these elements are divided through dicing. The matching layer 30 and the piezoelectric material 40 are divided such that a partitioned piezoelectric unit is connected with each flat wire 51 exposed at the front side 52 of the backing material 50. Accordingly, the partitioned piezoelectric units 40 may be arranged in a desired manner; for example, in a mesh form wherein the units 40 correspond to the flat wires 51 which were aligned in a matrix form inside the backing material 50 (see FIG. 9). After dividing the matching layer 30 and the piezoelectric material 40, a protective layer 20 and an acoustic lens 10 are provided on a front side of the matching layer 30 (see FIGS. 1 and 2), while the FPCB 60 is provided on the rear side 53 of the backing material 50.

As detailed above, the ultrasound probe and the method for manufacturing the same according to the exemplary embodiments have advantages in that a signal cable to supply electrical signal to a piezoelectric material is fabricated using a flat wire, enabling simple connection between separate piezoelectric units and the signal cable. Moreover, by reducing a distance between the partitioned piezoelectric units, an ultrasound probe equipped with a multi-element type piezoelectric material may be easily fabricated. Therefore, an ultrasound probe with improved sensitivity may be manufactured.

While exemplary embodiments have been particularly shown and described, it will be understood by those of ordinary skill in the art that various changes in form and details may be made therein without departing from the spirit and scope of the inventive concept as defined by the following claims.

What is claimed is:

1. An ultrasound probe comprising:

a piezoelectric material;

a matching layer which is disposed on a front side of the piezoelectric material;

an acoustic lens which is disposed on a front side of the matching layer;

backing material which is disposed on a rear side of the piezoelectric material, the backing material comprising:

a front side, a rear side opposite the front side, a lateral side between the front side and the rear side, individual grooves extending in a direction from the front side to the rear side, and a plurality of flat wires formed in corresponding individual grooves of the backing material and exposed at the lateral side and the rear side; and a signal supply part which is provided proximate to at least one of the lateral side and the rear side of the backing material and is electrically connected to the plurality of flat wires exposed on the backing material, to supply electrical signals to the backing material.

2. The ultrasound probe according to claim 1, wherein the signal supply part is a flexible printed circuit board (FPCB), a printed circuit board (PCB) or an electrical wire.

3. The ultrasound probe according to claim 1, wherein the plurality of flat wires are disposed in and extend through the backing material such that a width direction of each of the plurality of flat wires corresponds to the width direction of the backing material.

4. The ultrasound probe according to claim 1, wherein the plurality of flat wires are aligned within the backing material to form multiple rows extending in a lengthwise direction of the backing material, and the rows are formed such that the flat wires in one of the rows are alternately arranged in the lengthwise direction with respect to the flat wires in the other one of the rows.

5. The ultrasound probe according to claim 1, wherein the plurality of flat wires are exposed at the front side of the backing material to supply electrical signals to the piezoelectric material.

6. The ultrasound probe according to claim 5, further comprising an electrode formed on at least one of the front side, the lateral side, and the rear side of the backing material.

7. The ultrasound probe according to claim 1, wherein the signal supply part is mounted on the lateral side or the rear side of the backing material.

8. The ultrasound probe according to claim 1, wherein the piezoelectric material and the matching layer are divided in a width direction into plural sections equal in number to a number of the plurality of flat wires.

9. The ultrasound probe according to claim 1, wherein the piezoelectric material includes a first electrode layer formed on the front side of the piezoelectric material and a second electrode layer formed on the rear side of the piezoelectric material.

10. The ultrasound probe according to claim 9, wherein the first electrode layer is a ground electrode connected to the signal supply part, while the second electrode layer is connected with the plurality of flat wires of the backing material.

11. A method for manufacturing an ultrasound probe comprising a piezoelectric material, a matching layer which is disposed on a front side of the piezoelectric material, an acoustic lens which is disposed on a front side of the matching layer, backing material which is disposed on a rear side of the piezoelectric material, the backing material comprising a front side, a rear side opposite the front side, a lateral side between the front side and the rear side, individual grooves extending in a direction from the front side to the rear side, and a plurality of flat wires formed in corresponding individual grooves of the backing material and exposed at the lateral side and the rear side, and a signal supply part which is provided proximate to at least one of the lateral side and the rear side of the backing material and is electrically connected to the plurality of flat wires exposed on the backing material, to supply electrical signals to the backing material, the method comprising:

preparing a jig having a plurality of grooves which are evenly spaced;

positioning the plurality of flat wires in the plurality of grooves of the jig;

embedding the jig in a molding material and removing the jig from the molding material to form the backing material having the plurality of flat wires disposed therein; and processing a surface of the backing material to expose a portion of each of the plurality of flat wires at the processed surface of the backing material.

12. The method according to claim 11, further comprising:

forming an electrode on at least one of a front side surface, a lateral side surface and a rear side surface of the processed backing material;

mounting the piezoelectric material on the front side of the backing material;

mounting the matching layer on the front side of the piezoelectric material;

dividing the piezoelectric material and the matching layer at constant intervals;

providing the acoustic lens on the front side of the matching layer; and providing the signal supply part on the lateral side or the rear side of the backing material.

13. The method according to claim 12, wherein the signal supply part is a flexible printed circuit board (FPCB), a printed circuit board (PCB) or an electrical wire.

14. The method according to claim 11, wherein the grooves of the jig are present on opposing first and second sides of the jig, and the grooves on the first and second sides are alternately arranged with respect to one another.

15. The method according to claim 11, wherein the molding material comprises a mixture of a first material and a second material, the first material is at least one of silicon, epoxy resin and rubber, and the second material is at least one of metal and ceramic powder.

16. The method according to claim 12, wherein the piezoelectric material and the matching layer are divided into partitioned units such that each partitioned unit of the piezoelectric material is connected with one of the plurality of flat wires disposed in the backing material.

17. A method for manufacturing an ultrasound probe comprising a piezoelectric material, a matching layer which is disposed on a front side of the piezoelectric material, an acoustic lens which is disposed on a front side of the matching layer, backing material which is disposed on a rear side of the piezoelectric material, the backing material comprising a front side, a rear side opposite the front side, a lateral side between the front side and the rear side, individual grooves extending in a direction from the front side to the rear side, and a plurality of flat wires formed in corresponding individual grooves of the backing material and exposed at the lateral side and the rear side, and a signal supply part which is provided proximate to at least one of the lateral side and the rear side of the backing material and is electrically connected to the plurality of flat wires exposed on the backing material, to supply electrical signals to the backing material, the method comprising:

preparing a plurality of jigs, each of the plurality of jigs having evenly spaced grooves;

positioning the plurality of flat wires in the grooves of each of the jigs;

charging a molding material between the jigs to embed the jigs in the molding material, and removing the jigs to form the backing material having the plurality of flat wires disposed therein;

processing a surface of the backing material to expose a portion of each of the plurality of flat wires at the processed surface of the backing material;

mounting the piezoelectric material on the front side of the backing material;

mounting the matching layer on the piezoelectric material;

dividing the piezoelectric material and the matching layer into multiple units, each divided unit having a constant area;

providing the acoustic lens on the front side of the matching layer; and providing the signal supply part on the rear side of the backing material.

18. The method according to claim 17, further comprising:

forming an electrode on at least one of the front side, the lateral side or the rear side of the processed backing material.

19. The method according to claim 17, wherein the signal supply part is a flexible printed circuit board (FPCB), a printed circuit board (PCB) or an electrical wire.

20. The method according to claim 17, wherein the piezoelectric material and the matching layer are divided into partitioned units in a mesh form such that each partitioned unit is connected with one of the flat wires disposed in the backing material.

21. The method according to claim 17, wherein the molding material comprises a mixture of a first material and a second material, the first material is at least one of silicon, epoxy resin and rubber, and the second material is at least one of a metal and ceramic powder.

22. The ultrasound probe according to claim 1, wherein each of the plurality of flat wires is a separate wire which is individually and separately embedded in each of the corresponding individual grooves of the backing material.

* * * * *